US008181315B2

(12) United States Patent
Szeglin et al.

(10) Patent No.: US 8,181,315 B2
(45) Date of Patent: May 22, 2012

(54) FLEXIBLE HANDLE INTERBOX CONNECTOR

(75) Inventors: John L. Szeglin, Sayville, NY (US); Joseph J. Royt, Fresh Meadows, NY (US)

(73) Assignee: Peck & Hale, L.L.C., West Sayville, NY (US)

( * ) Notice: Subject to any disclaimer, the term of this patent is extended or adjusted under 35 U.S.C. 154(b) by 796 days.

(21) Appl. No.: 12/252,946

(22) Filed: Oct. 16, 2008

(65) Prior Publication Data

US 2009/0097937 A1 Apr. 16, 2009

Related U.S. Application Data

(60) Provisional application No. 60/999,288, filed on Oct. 16, 2007.

(51) Int. Cl.
*B65D 21/02* (2006.01)

(52) U.S. Cl. ..... 24/287

(58) Field of Classification Search ..... 24/287; 403/325, 385, 348; 410/78, 79, 82
See application file for complete search history.

(56) References Cited

U.S. PATENT DOCUMENTS

| | | | | |
|---|---|---|---|---|
| 2,423,640 | A * | 7/1947 | Dally | 30/340 |
| 4,196,673 | A * | 4/1980 | Looks | 410/89 |
| 4,873,742 | A * | 10/1989 | Dillon | 16/421 |
| 6,638,287 | B2 * | 10/2003 | Danitz et al. | 606/157 |

* cited by examiner

*Primary Examiner* — James Brittain
(74) *Attorney, Agent, or Firm* — Schroeder Law PC

(57) ABSTRACT

An interbox connector having a body with upper and lower cone portions and a flexible handle extending from the body for operating the cones. The flexible handle includes a continuous section of flexible wire and a plurality of sleeves which surround and are secured about the wire.

11 Claims, 4 Drawing Sheets

FLEXIBLE HANDLE INTERBOX CONNECTOR

This application claims the benefit of U.S. Provisional Application Ser. No. 60/999,288 filed Oct. 16, 2007, the disclosure of which is hereby incorporated by reference in its entirety.

BACKGROUND OF THE INVENTION

The present invention relates to interbox connectors and, more particularly, to an interbox connector having a flexible handle which is resistant to breakage/damage during usage thereof.

An Interbox Connector (IBC) is a steel connecting device made up of a forged cone housed between two cast body halves bolted together. The cone typically has a triangular upper cone portion and a relatively flat lower cone portion, which are connected by a shaft extending therebetween. The upper and lower cone portions are configured to engage the respective upper and lower corner fittings of the container. The cone may be rotated (e.g., 45 degrees) between an unlocked position and a locked position by moving the operating handle between a first position and a second position.

Manually-operated IBCs are typically used for connecting and securing containers on a rail car. The IBC is located between the top of the first tier container and the bottom of the second tier container, and is locked by turning the operating handle.

Prior art IBCs generally use a round steel bar rigid handle that is welded perpendicular to the cone shaft. The handle protrudes through the center of the two cast body halves. While this rigid handle serves its function by allowing simple locking and unlocking of the IBC, it is subject to bending or breakage during normal operation. In particular, IBCs are often thrown to the ground, are impacted by containers being landed or removed, and/or subjected to general mishandling. As a result, the railroad industry is forced to spend large sums of money each year fixing bent or broken handles and/or purchasing IBC replacements.

There is therefore a need in the art for an interbox connector having an improved handle mechanism which is resistant to breakage/damage from the impact forces typically encountered by such device.

SUMMARY OF THE INVENTION

The present invention, which addresses the needs of the prior art, relates to an interbox connector. The connector includes a body having upper and lower cone portions. The connector further includes a handle extending from the body and communicating with the cones whereby movement of the handle between a first position and a second position rotates the cone portions between a first installation orientation and a second locking orientation. The handle includes a continuous section of flexible wire and a plurality of sleeves which surround and are secured about said wire.

In one preferred embodiment, the upper and lower cone portions are interconnected via a cone shaft, one end of the handle being secured to the cone shaft. In another preferred embodiment, the sleeves include a first sleeve section having one end thereof secured to the cone shaft and having a length sufficient to allow the first sleeve to protrude outward from the base. In still another preferred embodiment, the sleeves further include a final sleeve section secured to the other end of the wire, the sleeves being located between the first sleeve section and the final sleeve section being installed in a tensioned state. In a still further embodiment, the sleeves are replaced by a plurality of beads.

The present invention also relates to an apparatus having a body and a handle extending therefrom. The body includes at least one moveable element. The handle, which extends from the body, communicates with the element whereby movement of the handle between a first position and a second position moves the element between a first orientation and a second orientation. The handle is formed from a continuous section of flexible wire and a plurality of sleeves surrounding and secured about such wire. In one preferred embodiment, these sleeves are installed in a tensioned state.

As a result, the present invention provides a flexible handle for an IBC which is resistant to bending/breaking. In particular, the rigid bar handle of the prior art has been replaced with an assembly which includes an elongated flexible member surrounded by a plurality of sleeves or beads positioned along the length thereof. The result is a handle that provides the proper combination of rigidity to allow handle operation (45 degree rotation), yet is flexible enough to allow significant impact in all directions. As a result, the flexible handle greatly reduces rework and repurchase costs, as well as reducing rail operation down time.

DETAILED DESCRIPTION OF THE INVENTION

Figure 1:
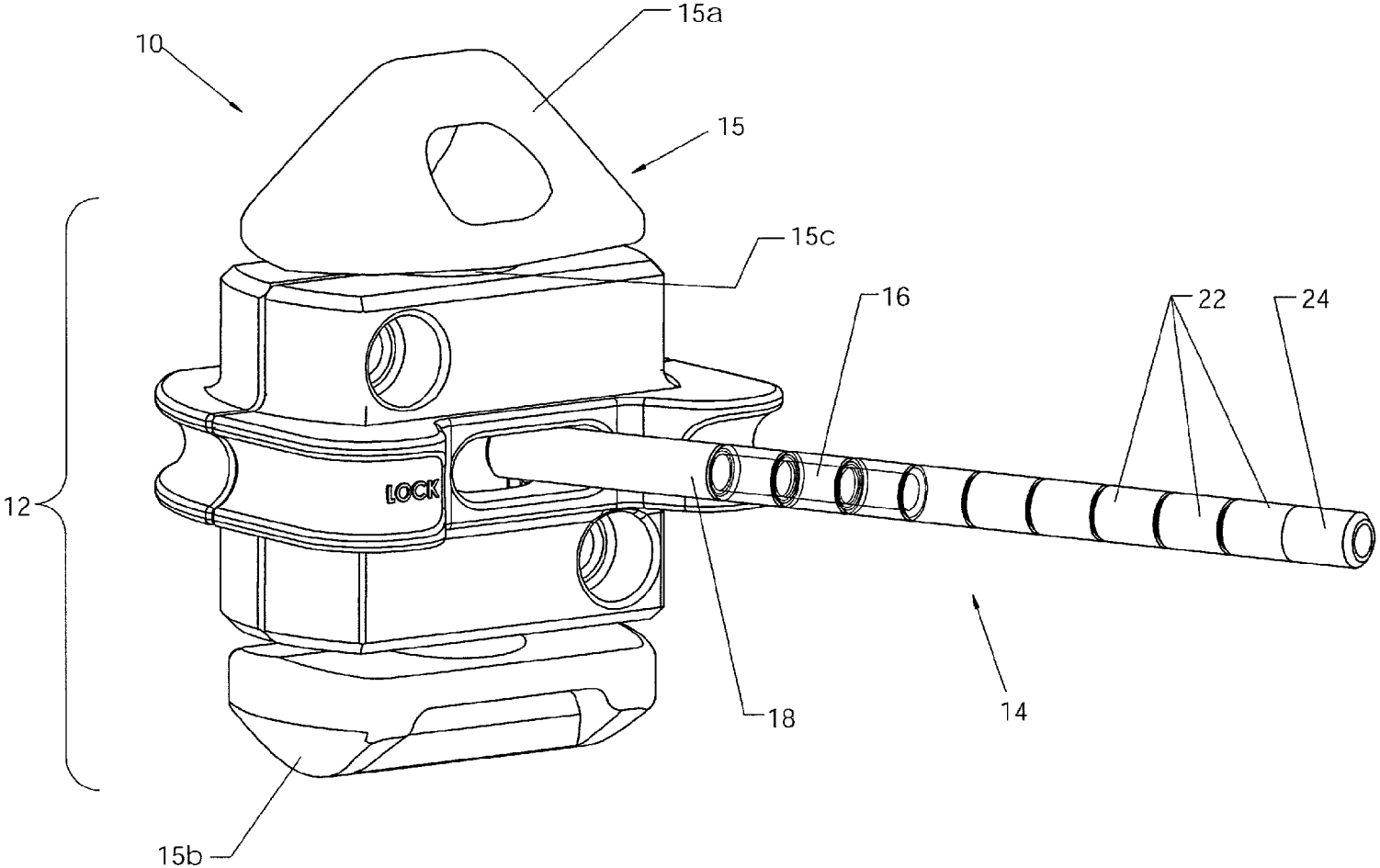
FIG. 1 is a perspective view of an interbox connector including the flexible handle of the present invention.

A flexible handle interbox connector 10 is shown in FIG. 1. IBC 10 includes a body 12 and a handle 14. Body 12 includes a cone 15 having an upper cone portion 15*a* and a lower cone portion 15*b*. The cone portions are interconnected by a shaft 15*c*. In accordance with the present invention, handle 14 provides sufficient rigidity to allow operation of the IBC, but is sufficiently flexible to absorb significant impact from any direction.

Figure 2A:
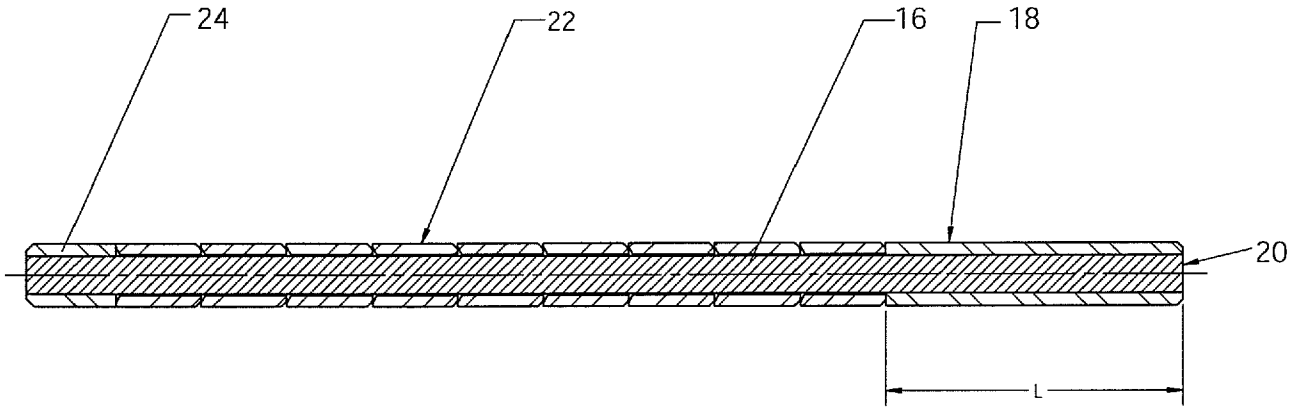
FIG. 2*a* is a sectional view taken along lines 2*a*-2*a* of FIG. 2.
Figure 2:
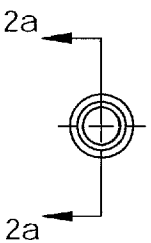
FIG. 2 is an end view of the handle of the present invention.

Referring to FIGS. 1 and 2, handle 14 includes a continuous section of flexible wire 16 extending for the substantial length of handle 14. Wire 16 may be formed from various metal, plastic or composite materials. In one preferred embodiment, wire 16 is formed from galvanized or stainless steel.

As best shown in FIG. 2, wire 16 is surrounded by a plurality of sleeves. A first sleeve 18 extends from end 20 of handle 14, and is provided with a length $L_1$ which allows sleeve 18 to protrude outward from the IBC a preselected distance (as best seen in FIG. 1). Length $L_1$ can be increased or decreased depending on the application. Sleeve 18 may be secured to wire 16 in any known manner, e.g, via a press-fitting operation or through the use of a compression fitting. In turn, end 20 is secured to cone shaft 15*c* extending through the IBC by, for example, welding sleeve 18 to such cone shaft. Of course, it is contemplated herein that end 20 of handle 14 may be secured to the cone shaft in other known manners.

A plurality of sleeves 22 are then positioned about wire 16, via either a clearance or an interference fit. A final sleeve section 24, which forms an end cap, is secured to the end of wire 16 in a permanent fashion, e.g., by press-fitting, welding or another similar procedure. In one preferred embodiment, the sleeves located between first sleeve 18 and final sleeve section 24 are installed in a tensioned state (in a direction extending along the length of the wire). This tensioned state tends to cause the sleeves to press against each other, thereby increasing the overall rigidity of the handle.

As shown, the individual sleeves 22 are discrete sections. As a result, the portion of the handle extending outward beyond the end of sleeve 18 is flexible, and will accordingly flex in response to forces applied thereto. It has been discovered herein that shorter sleeve lengths will provide a more flexible handle and that longer sleeve lengths will provide a more rigid handle. In one preferred embodiment, sleeves 22 have a length from about ½" to about 1".

As best seen in FIG. 2, the individual sleeves 22 are preferably formed with chamfered and/or rounded edges to facilitate flexing. In one preferred embodiment, the sleeve sections are formed from a metal material, e.g., galvanized steel or alloy steel, and can be cut from tubular stock or rolled from flat stock. Of course, sleeves 22 can be formed from other suitable materials such as plastic or composites.

Figure 3:
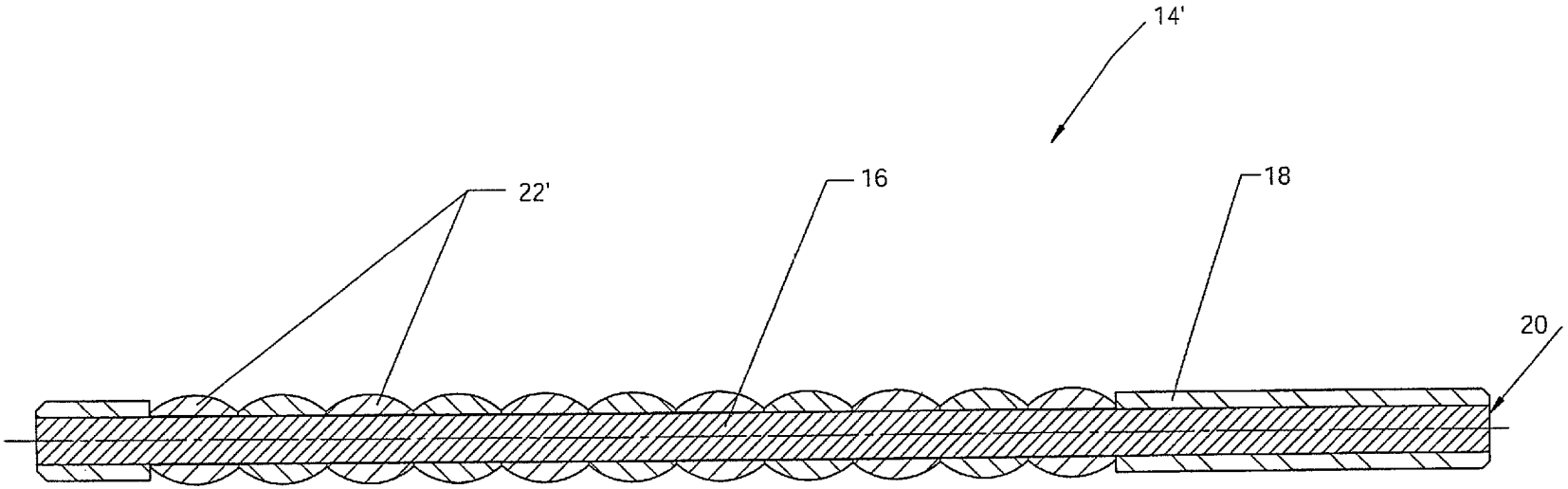
FIG. 3 is a detail of a first alternative embodiment.

In a first alternative embodiment (as shown in FIG. 3), the sleeves on handle 14' are replaced with a plurality of beads 22'. The beads are preferably installed about wire 16 in a tensioned state, and may be used in applications requiring different handle specifications and/or in response to manufacturing requirements. The beads may be formed from any suitable material, including metal, plastic or composites.

Figure 4:
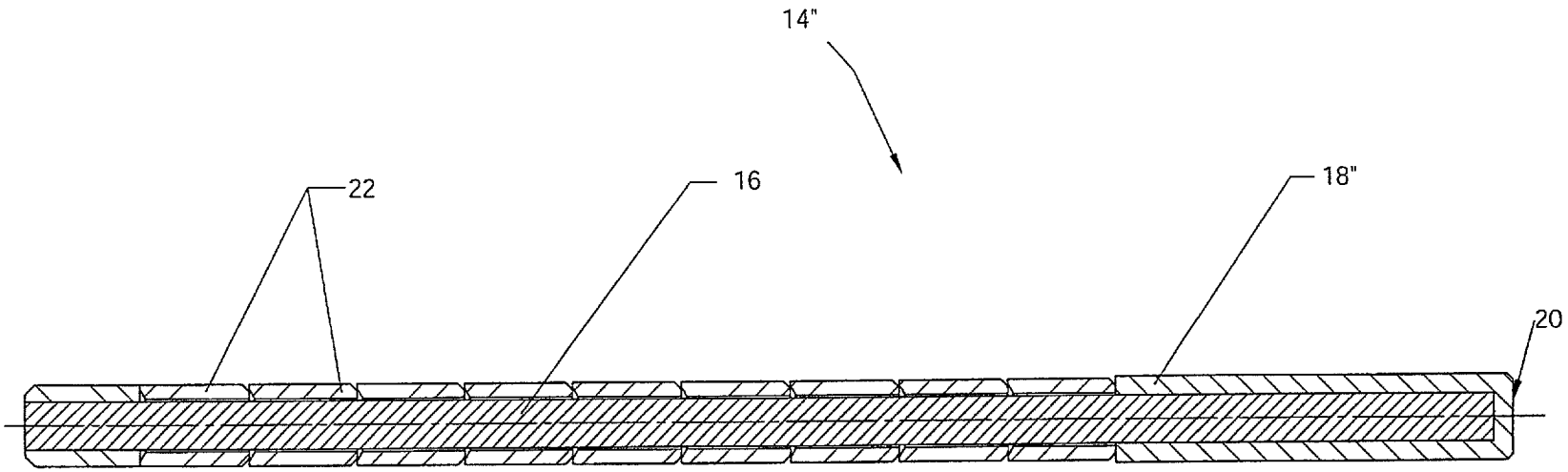
FIG. 4 is a detail of a second alternative embodiment.

In a second alternative embodiment (as shown in FIG. 4), sleeve 18 is replaced with a solid tubular section 18" having an axially-extending aperture into which wire 16 of handle 14" is installed and secured.

It will be appreciated that the present invention has been described herein with reference to certain preferred or exemplary embodiments. The preferred or exemplary embodiments described herein may be modified, changed, added to or deviated from without departing from the intent, spirit and scope of the present invention, and it is intended that all such additions, modifications, amendment and/or deviations be included within the scope of the followings claims.

What is claimed is:

1. An interbox connector, comprising:

a body including upper and lower cone portions; and a handle extending from said body and communicating with said cones whereby movement of said handle between a first position and a second position rotates said cone portions between a first installation orientation and a second locking orientation, said handle including a continuous section of flexible wire and a plurality of sleeves surrounding and secured about said wire.

2. The connector according to claim 1, wherein said upper and lower cone portions are interconnected via a cone shaft, and wherein one end of said handle is secured to said cone shaft.

3. The connector according to claim 2, wherein each of said sleeves is a discrete section having a length from about ½" to about 1".

4. The connector according to claim 2, wherein said sleeves include a first sleeve section having one end thereof secured to said cone shaft and having a length sufficient to allow said first sleeve to protrude outward from said base.

5. The connector according to claim 4, wherein said first sleeve section is press-fit onto one end of said wire.

6. The connector according to claim 4, wherein said sleeves further include a final sleeve section secured to the end of said wire opposite said first sleeve section, and wherein said sleeves located between said first sleeve section and said final sleeve section are installed in a tensioned state.

7. The connector according to claim 6, wherein said final sleeve section is press-fit onto the end of said wire.

8. The connector according to claim 6, wherein each of said sleeves includes chambered or rounded edges to facilitate flexing of said handle.

9. The connector according to claim 8, wherein said sleeves and said wire are formed from galvanized steel or alloy steel.

10. The connector according to claim 2, wherein said handle includes a solid tubular section extending from and secured to said cone shaft, said tubular section including an axially-extending aperture sized for receipt of one end of said wire therein.

11. An interbox connector, comprising:

a body including upper and lower cone portions; and a handle extending from said body and communicating with said cones whereby movement of said handle between a first position and a second position rotate said cone portions between a first installation orientation and a second locking orientation, said handle including a continuous section of flexible wire and a plurality of beads surrounding and secured about said wire.

* * * * *